US009459548B2

(12) United States Patent
Yoshie et al.

(10) Patent No.: US 9,459,548 B2
(45) Date of Patent: Oct. 4, 2016

(54) LIQUID DEVELOPER

(71) Applicant: Konica Minolta, Inc., Chiyoda-ku (JP)

(72) Inventors: Naoki Yoshie, Ibaraki (JP); Satoshi Matsumoto, Kyoto (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 17 days.

(21) Appl. No.: 14/488,796

(22) Filed: Sep. 17, 2014

(65) Prior Publication Data

US 2015/0086920 A1 Mar. 26, 2015

(30) Foreign Application Priority Data

Sep. 20, 2013 (JP) ..... 2013-194933

(51) Int. Cl.
*G03G 9/13* (2006.01)
*G03G 9/093* (2006.01)
*G03G 9/12* (2006.01)

(52) U.S. Cl.
CPC ..... *G03G 9/131* (2013.01); *G03G 9/09392* (2013.01); *G03G 9/122* (2013.01); *G03G 9/132* (2013.01)

(58) Field of Classification Search
CPC ..... G03G 9/13; G03G 9/131; G03G 9/132; G03G 9/133
USPC ..... 430/114
See application file for complete search history.

(56) References Cited

U.S. PATENT DOCUMENTS 5,254,424 A * 10/1993 Felder ..... G03G 9/132 430/112
2009/0023089 A1 1/2009 Teshima et al.
2014/0087303 A1* 3/2014 Hayashi ..... G03G 9/13 430/114
2014/0370436 A1* 12/2014 Yoshie ..... G03G 9/132 430/115

FOREIGN PATENT DOCUMENTS

JP 2009-042730 A 2/2009
JP 2009-096994 A 5/2009

* cited by examiner

*Primary Examiner* — Christopher Rodee
(74) *Attorney, Agent, or Firm* — Buchanan Ingersoll & Rooney PC

(57) ABSTRACT

A resin in a liquid developer contains a first resin which is a urethane-modified polyester resin resulting from increase in chain length of a component derived from a polyester resin by a compound containing an isocyanate group and a second resin. The first resin is contained by not lower than 70 mass % with respect to a total of the first resin and the second resin. The component derived from the polyester resin includes a constitutional unit derived from an acid component and a constitutional unit derived from an alcohol component. A ratio of a constitutional unit derived from an aliphatic monomer occupied in the constitutional unit derived from the acid component and the constitutional unit derived from the alcohol component is not lower than 80 mass %. Relation of $2.3 \leq Mw/Mn \leq 4$ ($10000 \leq Mn \leq 50000$) is satisfied.

17 Claims, 2 Drawing Sheets

LIQUID DEVELOPER

This application is based on Japanese Patent Application No. 2013-194933 filed with the Japan Patent Office on Sep. 20, 2013, the entire content of which is hereby incorporated by reference.

BACKGROUND OF THE INVENTION

1. Field of the Invention

The present invention relates to a liquid developer containing an insulating liquid and toner particles which are dispersed in the insulating liquid and contain a resin and a coloring agent.

2. Description of the Related Art

From a point of view of prevention of fly-off of toner particles during handling, a liquid developer has increasingly been used. A liquid developer has been required to have low-temperature fixability, fixability, and heat resistance, and various studies have been conducted (for example, Japanese Laid-Open Patent Publication No. 2009-042730 and Japanese Laid-Open Patent Publication No. 2009-096994).

SUMMARY OF THE INVENTION

Low-temperature fixability and heat resistance of the liquid developer are conflicting characteristics, however, achievement of both of such conflicting characteristics has been demanded. It has been found that achievement of both of such conflicting characteristics leads to lowering in damage resistance of a document (a toner layer formed on such a recording medium as paper).

The present invention was made in view of such aspects, and an object of the present invention is to provide a liquid developer which has excellent low-temperature fixability and heat resistance and can achieve prevention of lowering in damage resistance of a document.

A liquid developer according to the present invention has an insulating liquid and toner particles which are dispersed in the insulating liquid and contain a resin and a coloring agent. The resin contains a first resin which is a urethane-modified polyester resin resulting from increase in chain length of a component derived from a polyester resin by a compound containing an isocyanate group and a second resin different from the first resin. The first resin is contained by not lower than 70 mass % with respect to a total of the first resin and the second resin. The component derived from the polyester resin contains a constitutional unit derived from an acid component and a constitutional unit derived from an alcohol component. A ratio of a constitutional unit derived from an aliphatic monomer occupied in the constitutional unit derived from the acid component and the constitutional unit derived from the alcohol component is not lower than 80 mass %. Relation of $2.3 \leq Mw/Mn \leq 4$ ($10000 \leq Mn \leq 50000$) is satisfied, where Mn represents a number average molecular weight of the first resin and Mw represents a weight average molecular weight of the first resin.

The "component derived from the polyester resin" means a polyester resin from which one or more atoms have been removed from terminal end(s), and it includes a polyester resin from which one hydrogen atom has been removed from each of opposing terminal ends and a polyester resin from which one hydrogen atom has been removed from one terminal end. A "chain length" means bonding between a component derived from a polyester resin and a compound containing an isocyanate group such that the urethane-modified polyester resin is linear. The "aliphatic monomer" is a monomer constituting the polyester resin and it preferably has a straight chain alkyl skeleton having a carbon number not smaller than 4.

The first resin preferably has a concentration of a urethane group not lower than 0.5% and not higher than 5%. A concentration of a urethane group in the first resin can be calculated as (a mass of a urethane group in a urethane-modified polyester resin)/(a mass of the urethane-modified polyester resin)×100.

The second resin is preferably a vinyl resin. The "vinyl resin" means a resin obtained by polymerizing a monomer having polymeric double bond.

The toner particles preferably have a core/shell structure. The "core/shell structure" is such a structure as having the first resin as a core and the second resin as a shell. The core/shell structure includes not only such a structure that the second resin covers at least a part of surfaces of first particles (the first particles containing the first resin) but also such a structure that the second resin adheres to at least a part of surfaces of the first particles.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

<Liquid Developer>

Figure 1:
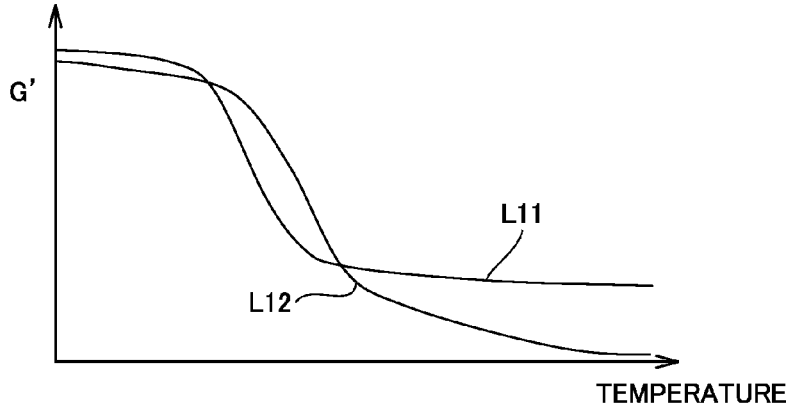
FIG. 1 is a graph schematically showing temperature dependency of a storage elastic modulus of a urethane-modified polyester resin.

A liquid developer according to the present embodiment is useful as a liquid developer for electrophotography used in an image formation apparatus of an electrophotography type (which will be described later) such as a copying machine, a printer, a digital printer, or a simple printer, a paint, a liquid developer for electrostatic recording, an oil-based ink for ink jet printer, or an ink for electronic paper. The liquid developer according to the present embodiment contains an insulating liquid and toner particles dispersed in the insulating liquid, and preferably contains 10 to 50 mass % of toner particles and 50 to 90 mass % of the insulating liquid. The liquid developer according to the present embodiment may contain any component other than the toner particles and the insulating liquid. Any component other than the toner particles and the insulating liquid is, preferably, for example, a charge control agent, a thickener, or a dispersant.

<Toner Particles>

Toner particles in the present embodiment contain a resin and a coloring agent dispersed in the resin. A content of each of the resin and the coloring agent in the toner particles is preferably determined such that desired image density is obtained when an amount of adhesion of toner particles to such a recording medium as paper is within a prescribed range. The toner particles according to the present embodiment may contain any component other than the resin and the coloring agent. Any component other than the resin and the coloring agent is, preferably, for example, a dispersant for a pigment, a wax, or a charge control agent.

<Resin>

The resin in the present embodiment contains the first resin and the second resin different from the first resin. The first resin is contained by not lower than 70 mass % with respect to the total of the first resin and the second resin. The second resin may be composed of one type of resin or two or more types of resins as mixed. A content of the first resin or the second resin in the resin can be found, for example, based on an infrared absorption spectrum, also on a spectrum obtained from nuclear magnetic resonance, or also on a GCMS (gas chromatograph mass spectrometer).

<First Resin>

The first resin is a urethane-modified polyester resin. A component derived from a polyester resin contains a constitutional unit derived from an acid component and a constitutional unit derived from an alcohol component. A ratio of a constitutional unit derived from an aliphatic monomer occupied in the constitutional unit derived form the acid component and the constitutional unit derived from the alcohol component is not lower than 80 mass %, preferably not lower than 90 mass %, and more preferably 100 mass %. This ratio may be found based on a spectrum obtained from nuclear magnetic resonance or with a GCMS. In the following, matters studied by the present inventors in completing the liquid developer according to the present embodiment are shown, and then the first resin in the present embodiment is further shown.

With the liquid developer, fly-off of toner particles during handling can be prevented. Therefore, the toner particles can be smaller in particle size than in a dry developer and hence an amount of adhesion of toner particles to a recording medium can be decreased. When an amount of adhesion of toner particles to a recording medium is decreased, however, image density is lowered, which leads to necessity for increase in content of a coloring agent. When a content of a coloring agent is increased on the other hand, melt viscosity of the liquid developer becomes higher and fixation at a low temperature becomes difficult. Therefore, conventionally, melt viscosity of the liquid developer has been lowered by adjusting a molecular weight of a non-linear polyester resin contained in toner particles.

The non-linear polyester resin does not have excellent crystallinity but has a glass transition point. Though a resin contained in toner particles is swollen with an insulating liquid, a non-linear polyester resin is lower in glass transition point when it is present in a liquid than when it is present in a dry state, which leads to lowering in heat resistance of the liquid developer. As a method of enhancing heat resistance of the liquid developer, it is possible to adjust a molecular weight of the non-linear polyester resin so as to raise a glass transition point thereof. Adoption of this method, however, results in difficulty in fixation at a low temperature.

As another method of enhancing heat resistance of the liquid developer, it is possible to employ a resin having excellent crystallinity as a resin to be contained in toner particles. As a result of dedicated studies conducted by the present inventors, it has been found that use of a urethane-modified polyester resin as a resin to be contained in toner particles can provide a liquid developer excellent in low-temperature fixability and heat resistance, which will be detailed below.

FIG. 1 is a graph schematically showing temperature dependency of a storage elastic modulus of a urethane-modified polyester resin. The abscissa in FIG. 1 represents a temperature and the ordinate in FIG. 1 represents G' (a storage elastic modulus). In FIG. 1, L11 represents a case where a concentration of a urethane group in a urethane-modified polyester resin is relatively high and L12 represents a case where a concentration of a urethane group in a urethane-modified polyester resin is relatively low.

As shown in FIG. 1, when a temperature of the urethane-modified polyester resin is around a softening temperature thereof, a storage elastic modulus thereof suddenly lowers. Therefore, fixation can be carried out around the softening temperature of the urethane-modified polyester resin. Generally, a softening temperature of a crystalline resin is lower than a glass transition point of a non-crystalline resin. Therefore, fixation at a low temperature can be carried out.

As shown in FIG. 1, when a temperature of the urethane-modified polyester resin is higher than a softening temperature thereof, a storage elastic modulus thereof does not significantly vary. Thus, the urethane-modified polyester resin has a region where a storage elastic modulus does not significantly vary (a stable region) in a temperature region higher than a softening temperature thereof (hereinafter denoted as a "high-temperature region"). Then, by varying a type of a monomer constituting a component derived from a polyester resin or a molecular weight of the urethane-modified polyester resin, a storage elastic modulus in the high-temperature region varies. For example, by raising a concentration of the urethane group in the urethane-modified polyester resin, the storage elastic modulus varies from L12 to L11 shown in FIG. 1, and thus heat resistance of the liquid developer can be enhanced. Specifically, occurrence of high-temperature offset (likeliness of adhesion of molten toner to a fixation roller during fixation) can be prevented.

The present inventors have recently found, however, that a liquid developer containing a urethane-modified polyester resin suffers an intrinsic problem shown below. It has been found that toughness of a urethane-modified polyester resin is lost when a molecular weight of the urethane-modified polyester resin is decreased. Therefore, damage resistance of a document may be lowered. It has been found, on the other hand, that a softening temperature of the urethane-modified polyester resin is lower as a molecular weight of the urethane-modified polyester resin is increased in order to prevent lowering in damage resistance of a document. Therefore, heat resistance of the liquid developer may lower, and specifically, document offset (likeliness of color transfer due to softening of toner particles during storage in a high-temperature condition or a pressurized condition, of a printed matter obtained by fixation of toner particles to a recording medium) may occur.

As a result of dedicated studies for solving the problem above, the present inventors have found that the problem above is solved by satisfying relation of $2.3 \leq Mw/Mn \leq 4$ ($10000 \leq Mn \leq 50000$), where Mn represents a number average molecular weight of the first resin and Mw represents a weight average molecular weight of the first resin.

Figure 2:
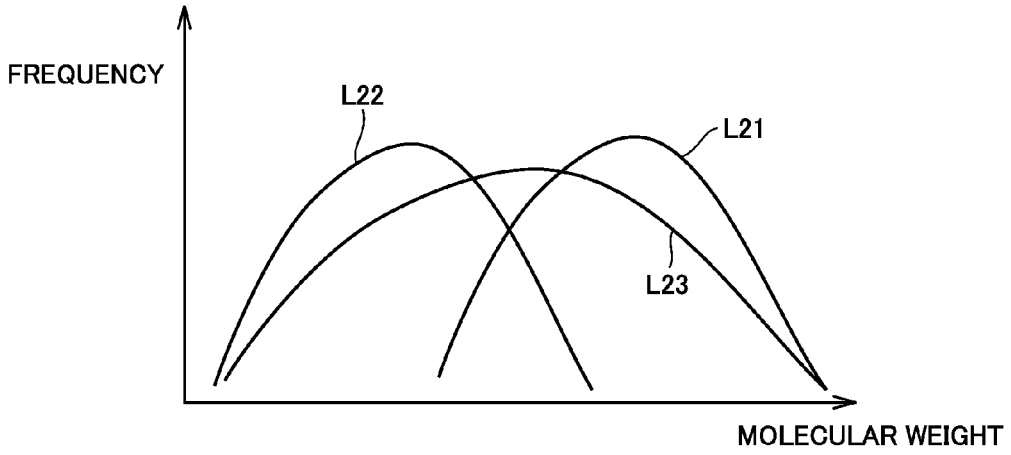
FIG. 2 is a graph schematically showing molecular weight distribution of the urethane-modified polyester resin.

FIG. 2 is a graph schematically showing molecular weight distribution of a urethane-modified polyester resin. In FIG. 2, L21 schematically represents molecular weight distribution when a molecular weight is great, L22 schematically represents molecular weight distribution when a molecular weight is small, and L23 schematically represents molecular weight distribution of the first resin.

Mw/Mn is an indicator of molecular weight distribution of the first resin. Greater Mw/Mn means wider molecular weight distribution of the first resin (a wide bandwidth of the graph shown in FIG. 2). When relation of 2.3≤Mw/Mn is satisfied, regardless of magnitude of Mn, occurrence of document offset can be prevented and lowering in damage resistance of a document can be prevented. It is expected that occurrence of a disadvantage depending on Mn can be prevented as Mw/Mn is greater. It is difficult, however, to prepare a urethane-modified polyester resin satisfying relation of Mw/Mn>4. Even if a urethane-modified polyester resin satisfying relation of Mw/Mn>4 can be prepared, high-temperature offset may occur or glossiness may lower. Therefore, relation of Mw/Mn≤4 is preferably satisfied. More preferably, relation of 2.5≤Mw/Mn≤3.5 is satisfied. Thus, occurrence of document offset can further be prevented and lowering in damage resistance of a document can further be prevented.

When Mw/Mn is smaller than 2.3 (2.3>Mw/Mn), however, it is difficult to achieve both of prevention of occurrence of document offset and prevention of lowering in damage resistance of a document. Specifically, as Mn is great, crystallinity of a urethane-modified polyester resin lowers and a softening temperature thereof lowers, which leads to occurrence of document offset. When Mn is small, toughness of the first resin is lost and hence damage resistance of a document is lowered.

When relation of 10000≤Mn is satisfied, excessive softening of the first resin during fixation can be prevented, and hence occurrence of high-temperature offset can be prevented. When relation of Mn≤50000 is satisfied, less likeliness of softening of the first resin during fixation can be prevented, and hence fixability can be ensured. Preferably, relation of 10000≤Mn≤30000 is satisfied. Thus, fixability can be improved. On the other hand, when Mn is smaller than 10000 (10000>Mn), the first resin may excessively be softened during fixation, and hence high-temperature offset may occur. When Mn is greater than 50000 (Mn>50000), the first resin may less likely to soften during fixation, and hence fixation strength may lower.

Mn and Mw of the first resin can be measured with gel permeation chromatography (GPC) under conditions below, with respect to solubles in tetrahydrofuran (THF). Based on measured Mn and Mw of the first resin, Mw/Mn can be calculated. Mn and Mw of a resin other than the polyester resin can also be measured under conditions shown below.

Measurement apparatus: "HLC-8120" manufactured by Tosoh Corporation

Column: "TSKgel GMHXL" (two) manufactured by Tosoh Corporation and "TSKgel Multipore HXL-M" (one) manufactured by Tosoh Corporation Sample solution: 0.25 mass % of THF solution Amount of injection of sample solution into column: 100 μl Flow rate: 1 ml/min.

Measurement temperature: 40° C.

Detection apparatus: Refraction index detector

Reference material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

A number average molecular weight and a mass average molecular weight of a polyester resin can be measured with the use of GPC under conditions below.

Measurement apparatus: "HLC-8220GPC" manufactured by Tosoh Corporation

Column: "Guardcolumn α" (one) and "TSKgel α-M" (one)

Sample solution: 0.125 mass % of dimethylformamide solution

Amount of injection of dimethylformamide solution into column: 100 μl

Flow rate: 1 ml/min.

Measurement temperature: 40° C.

Detection apparatus: Refraction index detector

Reference material: 12 standard polystyrenes manufactured by Tosoh Corporation (TSK standard POLYSTYRENE) (molecular weight: 500, 1050, 2800, 5970, 9100, 18100, 37900, 96400, 190000, 355000, 1090000, 2890000)

In order to satisfy relation of 2.3≤Mw/Mn≤4, the first resin preferably contains two or more types of urethane-modified polyester resins different from each other in number average molecular weight. For example, by mixing the urethane-modified polyester resin having molecular weight distribution shown with L21 in FIG. 2 and the urethane-modified polyester resin having molecular weight distribution shown with L22 in FIG. 2 with each other, a urethane-modified polyester resin having molecular weight distribution shown with L23 in FIG. 2 (a urethane-modified polyester resin having wide molecular weight distribution) is obtained. More specifically, the first resin preferably contains at least 5 mass % and at most 80 mass % of a low-molecular-weight urethane-modified polyester resin and at least 20 mass % and at most 95 mass % of a high-molecular-weight urethane-modified polyester resin. The low-molecular-weight urethane-modified polyester resin has a number average molecular weight preferably not smaller than 3000 and not greater than 25000, and the high-molecular-weight urethane-modified polyester resin has a number average molecular weight preferably at least 1.5 time and at most 10 times as great as the number average molecular weight of the low-molecular-weight urethane-modified polyester resin.

Since the two or more types of urethane-modified polyester resins contained in the first resin are preferably identical in thermophysical properties, the low-molecular-weight urethane-modified polyester resin and the high-molecular-weight urethane-modified polyester resin are preferably identical in constitutional unit. Here, a urethane-modified polyester resin is obtained in accordance with a method shown below. Initially, a polyester resin (a skeleton) is obtained by polymerizing polyol with polycarboxylic acid, acid anhydride of polycarboxylic acid, or ester of lower alkyl of polycarboxylic acid. The obtained polyester resin is increased in chain length by di(tri)isocyanate. Di(tri)isocyanate means diisocyanate and/or triisocyanate. Therefore, the low-molecular-weight urethane-modified polyester resin and the high-molecular-weight urethane-modified polyester resin are preferably identical in composition of a polyol component and preferably also in composition of such an acid component as a polycarboxylic acid component. Therefore, a number average molecular weight of the urethane-modified polyester resin is preferably varied by varying a degree of polymerization of a monomer in a component derived from the polyester resin or a concentration of a urethane group in the first resin.

The first resin may further contain a first urethane-modified polyester resin smaller in number average molecular weight than the low-molecular-weight urethane-modified polyester resin. The first resin may further contain a second urethane-modified polyester resin greater in number average molecular weight than the high-molecular-weight urethane-modified polyester resin. The first resin may further contain a third urethane-modified polyester resin greater in number average molecular weight than the low-molecular-weight urethane-modified polyester resin and smaller in number average molecular weight than the high-molecular-weight urethane-modified polyester resin.

<Crystallinity>

Since a ratio of the constitutional unit derived from the aliphatic monomer occupied in the constitutional unit derived from the acid component and the constitutional unit derived from the alcohol component is not lower than 90 mass %, the first resin is considered to be excellent in crystallinity. Here, "crystallinity" means that a ratio between a softening point of the resin (hereinafter abbreviated as "Tmp") and a maximum peak temperature (hereinafter abbreviated as "Ta") of heat of fusion of the resin (Tmp/Ta) is not lower than 0.8 and not higher than 1.55 and that a result of change in amount of heat obtained in differential scanning calorimetry (DSC) does not show stepwise change in amount of heat absorption but has a clear heat absorption peak. A ratio between Tmp and Ta (Tmp/Ta) being higher than 1.55 can mean that such a resin is not excellent in crystallinity and also that such a resin has non-crystallinity.

A flow tester (capillary rheometer) (such as CFT-500D manufactured by Shimadzu Corporation) can be used to measure Tmp. Specifically, while 1 g of a sample is heated at a temperature increase rate of 6° C./min., a plunger applies load of 1.96 MPa to the sample to thereby extrude the sample from a nozzle having a diameter of 1 mm and a length of 1 mm. Relation between "an amount of lowering of the plunger (a value of flow)" and a "temperature" is plotted in a graph. A temperature at the time when an amount of lowering of the plunger is ½ of a maximum value of the amount of lowering is read from the graph, and this value (a temperature at which half of the measurement sample was extruded from the nozzle) is adopted as Tmp. In the present embodiment, a softening temperature of the first resin is preferably not lower than 40° C. from a point of view of prevention of occurrence of document offset and preferably not higher than 80° C. from a point of view of low-temperature fixability.

A differential scanning calorimeter (such as "DSC210" manufactured by Seiko Instruments, Inc.) can be used to measure Ta. Specifically, a sample is molten at 130° C., thereafter a temperature is lowered from 130° C. to 70° C. at a rate of 1.0° C./min., and thereafter a temperature is lowered from 70° C. to 10° C. at a rate of 0.5° C./min. Thereafter, with the DSC method, a temperature of the sample is raised at a temperature increase rate of 20° C./min., change in heat absorption and generation of the sample is measured, and relation between an "amount of heat absorption and generation" and a "temperature" is plotted in a graph. Here, a temperature of a heat absorption peak observed in a range from 20 to 100° C. is defined as Ta'. When there are a plurality of heat absorption peaks, a temperature of a peak largest in amount of heat absorption is defined as Ta'. After the sample was stored for 6 hours at (Ta'−10°) C., it is in turn stored for 6 hours at (Ta'−15°) C.

After pre-treatment of the sample ends, with the DSC method, the sample subjected to the pre-treatment above is cooled to 0° C. at a temperature lowering rate of 10° C./min., and then a temperature is raised at a temperature increase rate of 20° C./min. Based on change in heat absorption and generation thus measured, relation between an "amount of heat absorption and generation" and a "temperature" is plotted in a graph. A temperature at which an amount of heat absorption attains to a maximum value is defined as a maximum peak temperature (Ta) of heat of fusion.

<Constitutional Unit>

A polyester resin obtained in a process for manufacturing the first resin is preferably a polycondensed product of polyol (an alcohol component) and polycarboxylic acid (an acid component), acid anhydride of polycarboxylic acid (an acid component), or ester of lower alkyl of polycarboxylic acid (having a carbon number of an alkyl group from 1 to 4) (an acid component). A known polycondensation catalyst can be used for polycondensation reaction. A ratio between polyol and polycarboxylic acid is not particularly limited. A ratio between polyol and polycarboxylic acid should only be set such that an equivalent ratio between a hydroxyl group [OH] and a carboxyl group [COOH]([OH]/[COOH]) is set preferably to 2/1 to 1/5, more preferably to 1.5/1 to 1/4, and further preferably to 1.3/1 to 1/3.

In the present embodiment, polyol preferably has a straight chain alkyl skeleton having a carbon number not smaller than 4 and more preferably it is aliphatic diol. Polycarboxylic acid preferably has a straight chain alkyl skeleton having a carbon number not smaller than 4 and more preferably it is aliphatic dicarboxylic acid. This is also the case with "polycarboxylic acid" in each of acid anhydride of polycarboxylic acid and lower alkyl of polycarboxylic acid. Thus, the first resin will express crystallinity. So long as the first resin expresses crystallinity, the first resin may contain aromatic polyol or aromatic polycarboxylic acid. For example, a ratio of a constitutional unit derived from an aromatic monomer occupied in the constitutional unit derived from the acid component and the constitutional unit derived from the alcohol component may be not higher than 20 mass %.

Aliphatic diol is one type of an aliphatic monomer, it is preferably alkane diol having a carbon number from 4 to 10, and it is more preferably, for example, ethylene glycol, 1,3-propylene glycol, 1,4-butanediol, 1,6-hexanediol, 1,9-nonanediol, or 1,10-decanediol.

Aliphatic dicarboxylic acid is one type of an aliphatic monomer, and it is preferably, for example, alkane dicarboxylic acid having a carbon number from 4 to 20, alkene dicarboxylic acid having a carbon number from 4 to 36, or an ester-forming derivative thereof. Aliphatic dicarboxylic acid is more preferably succinic acid, adipic acid, sebacic acid, maleic acid, fumaric acid, or an ester-forming derivative thereof.

A compound containing an isocyanate group is preferably a compound having a plurality of isocyanate groups in a molecule, and it is more preferably chain aliphatic polyisocyanate or cyclic aliphatic polyisocyanate.

Chain aliphatic polyisocyanate is preferably, for example, ethylene diisocyanate, tetramethylene diisocyanate, hexamethylene diisocyanate (hereinafter abbreviated as "HDI"), dodecamethylene diisocyanate, 1,6,11-undecane triisocyanate, 2,2,4-trimethyl hexamethylene diisocyanate, lysine diisocyanate, 2,6-diisocyanatomethyl caproate, bis(2-isocyanatoethyl) fumarate, bis(2-isocyanatoethyl) carbonate, 2-isocyanatoethyl-2,6-diisocyanatohexanoate, or the like. Two or more of these may be used together.

Cyclic aliphatic polyisocyanate is preferably, for example, isophoron diisocyanate (hereinafter abbreviated as "IPDI"), dicyclohexylmethane-4,4'-diisocyanate (hereinafter also denoted as "hydrogenated MDT"), cyclohexylene diisocyanate, methylcyclohexylene diisocyanate (hereinafter also denoted as "hydrogenated TDI"), bis(2-isocyanatoethyl)-4-cyclohexene-1,2-dicarboxylate, 2,5-norbornane diisocyanate, or 2,6-norbornane diisocyanate. Two or more of these may be used together.

<Concentration of Urethane Group>

A concentration of a urethane group in the first resin is preferably not lower than 0.5% and not higher than 5%. Thus, a storage elastic modulus of the first resin in a high-temperature region can be set to an appropriate value. Therefore, fixability can be ensured and occurrence of high-temperature offset can be prevented. A concentration of a urethane group in the first resin in the present embodiment is preferably not lower than 1% and not higher than 3%. Thus, fixability can be enhanced and occurrence of high-temperature offset can further be prevented.

A concentration of a urethane group in the first resin can be measured with a GCMS. Specifically, under conditions shown below (conditions for pyrolysis of a urethane-modified polyester resin), a urethane-modified polyester resin is pyrolyzed. Then, a concentration of a urethane group is measured with a GCMS under conditions shown below (conditions for measurement of a concentration of a urethane group in the urethane-modified polyester resin). Then, a concentration of a urethane group in the first resin is calculated by using a ratio of ion intensity detected from the thermally decomposed urethane-modified polyester resin.

(Conditions for Pyrolysis of Urethane-Modified Polyester Resin)

Apparatus: PY-2020iD manufactured by Frontier Laboratories Ltd.

Mass of sample: 0.1 mg

Heating temperature: 550° C.

Heating time period: 0.5 minute (Conditions for Measurement of Concentration of Urethane Group in Urethane-Modified Polyester Resin)

Apparatus: GCMS-QP2010 manufactured by Shimadzu Corporation

Column: UltraALLOY-5 manufactured by Frontier Laboratories Ltd. (inner diameter: 0.25 mm, length: 30 m, thickness: 0.25 μm)

Temperature increase condition: Temperature Increase Range: 100° C. to 320° C. (held at 320° C.), Rate of Temperature Increase: 20° C./min.

<Second Resin>

The second resin is preferably, for example, a vinyl resin, a polyester resin, a polyurethane resin, an epoxy resin, a polyamide resin, a polyimide resin, a silicon resin, a phenol resin, a melamine resin, a urea resin, an aniline resin, an ionomer resin, or a polycarbonate resin. The second resin is more preferably a vinyl resin, a polyester resin, a polyurethane resin, or an epoxy resin, and further preferably a vinyl resin. Thus, a median diameter D50 (which will be described later) of toner particles and circularity (which will be described later) of toner particles are readily controlled. The second resin preferably also has crystallinity.

The vinyl resin may be a homopolymer obtained by homopolymerizing a monomer having polymeric double bond or a copolymer obtained by copolymerizing two or more types of monomers having polymeric double bond. A monomer having polymeric double bond is, for example, (1) to (9) below.

(1) Hydrocarbon Having Polymeric Double Bond

Hydrocarbon having polymeric double bond is preferably, for example, aliphatic hydrocarbon having polymeric double bond shown in (1-1) below, aromatic hydrocarbon having polymeric double bond shown in (1-2) below, or the like.

(1-1) Aliphatic Hydrocarbon Having Polymeric Double Bond

Aliphatic hydrocarbon having polymeric double bond is preferably, for example, chain hydrocarbon having polymeric double bond shown in (1-1-1) below, cyclic hydrocarbon having polymeric double bond shown in (1-1-2) below, or the like.

(1-1-1) Chain Hydrocarbon Having Polymeric Double Bond

Chain hydrocarbon having polymeric double bond is preferably, for example, alkene having a carbon number from 2 to 30 (such as ethylene, propylene, butene, isobutylene, pentene, heptene, diisobutylene, octene, dodecene, or octadecene); alkadiene having a carbon number from 4 to 30 (such as butadiene, isoprene, 1,4-pentadiene, 1,5-hexadiene, or 1,7-octadiene); or the like.

(1-1-2) Cyclic Hydrocarbon Having Polymeric Double Bond

Cyclic hydrocarbon having polymeric double bond is preferably, for example, mono- or di-cycloalkene having a carbon number from 6 to 30 (such as cyclohexene, vinyl cyclohexane, or ethylidene bicycloheptane); mono- or di-cycloalkadiene having a carbon number from 5 to 30 (such as cyclopentadiene or dicyclopentadiene); or the like.

(1-2) Aromatic Hydrocarbon Having Polymeric Double Bond

Aromatic hydrocarbon having polymeric double bond is preferably, for example, styrene; hydrocarbyl (such as alkyl, cycloalkyl, aralkyl, and/or alkenyl having a carbon number from 1 to 30) substitute of styrene (such as α-methylstyrene, vinyl toluene, 2,4-dimethylstyrene, ethylstyrene, isopropylstyrene, butylstyrene, phenylstyrene, cyclohexylstyrene, benzylstyrene, crotylbenzene, divinyl benzene, divinyl toluene, divinyl xylene, or trivinyl benzene); vinyl naphthalene; or the like.

(2) Monomer Having Carboxyl Group and Polymeric Double Bond and Salt Thereof

A monomer having a carboxyl group and polymeric double bond is preferably, for example, unsaturated monocarboxylic acid having a carbon number from 3 to 15 [such as (meth)acrylic acid, crotonic acid, isocrotonic acid, or cinnamic acid]; unsaturated dicarboxylic acid (unsaturated dicarboxylic anhydride) having a carbon number from 3 to 30 [such as maleic acid (maleic anhydride), fumaric acid, itaconic acid, citraconic acid (citraconic anhydride), or mesaconic acid]; monoalkyl (having a carbon number from 1 to 10) ester of unsaturated dicarboxylic acid having a carbon number from 3 to 10 (such as maleic acid monomethyl ester, maleic acid monodecyl ester, fumaric acid monoethyl ester, itaconic acid monobutyl ester, or citraconic acid monodecyl ester); or the like. "(Meth)acrylic" herein means acrylic and/or methacrylic.

The salt of the monomer above is preferably, for example, alkali metal salt (such as sodium salt or potassium salt), alkaline earth metal salt (such as calcium salt or magnesium salt), ammonium salt, amine salt, or quaternary ammonium salt, or the like.

Amine salt is not particularly limited so long as it is an amine compound. Amine salt is preferably, for example, primary amine salt (such as ethylamine salt, butylamine salt, or octylamine salt); secondary amine salt (such as diethylamine salt or dibutylamine salt); tertiary amine salt (such as triethylamine salt or tributylamine salt); or the like.

Quaternary ammonium salt is preferably, for example, tetraethyl ammonium salt, triethyl lauryl ammonium salt, tetrabutyl ammonium salt, or tributyl lauryl ammonium salt, or the like.

Salt of the monomer having a carboxyl group and polymeric double bond is preferably, for example, sodium acrylate, sodium methacrylate, monosodium maleate, disodium maleate, potassium acrylate, potassium methacrylate, mono-potassium maleate, lithium acrylate, cesium acrylate, ammonium acrylate, calcium acrylate, or aluminum acrylate, or the like.

(3) Monomer Having Sulfo Group and Polymeric Double Bond and Salt Thereof

A monomer having a sulfo group and polymeric double bond is preferably, for example, vinyl sulfonic acid, α-methylstyrene sulfonic acid, sulfopropyl (meth)acrylate, or 2-(meth)acryloylamino-2,2-dimethylethane sulfonic acid. Salt of a monomer having a sulfo group and polymeric double bond is preferably, for example, salts listed as the "salt of the monomer above" in "(2) Monomer Having Carboxyl Group and Polymeric Double Bond" above.

(4) Monomer Having Phosphono Group and Polymeric Double Bond and Salt Thereof

A monomer having a phosphono group and polymeric double bond is preferably, for example, 2-hydroxyethyl (meth)acryloyl phosphate or 2-acryloyloxy ethyl phosphonic acid. Salt of the monomer having a phosphono group and polymeric double bond is preferably, for example, salts listed as the "salt of the monomer above" in "(2) Monomer Having Carboxyl Group and Polymeric Double Bond" above.

(5) Monomer Having Hydroxyl Group and Polymeric Double Bond

A monomer having a hydroxyl group and polymeric double bond is preferably, for example, hydroxystyrene, N-methylol (meth)acrylamide, or hydroxyethyl (meth)acrylate.

(6) Nitrogen-Containing Monomer Having Polymeric Double Bond

A nitrogen-containing monomer having polymeric double bond is preferably, for example, a monomer shown in (6-1) to (6-4) below.

(6-1) Monomer Having Amino Group and Polymeric Double Bond

A monomer having an amino group and polymeric double bond is preferably, for example, aminoethyl (meth)acrylate, dimethylaminoethyl (meth)acrylate, diethylaminoethyl (meth)acrylate, t-butylaminoethyl (meth)acrylate, N-aminoethyl (meth)acrylamide, (meth)allyl amine, morpholinoethyl (meth)acrylate, 4-vinylpyridine, 2-vinylpyridine, crotyl amine, N,N-dimethylamino styrene, methyl-α-acetamino acrylate, vinylimidazole, N-vinylpyrrole, N-vinyl thiopyrrolidone, N-aryl phenylenediamine, aminocarbazole, aminothiazole, aminoindole, aminopyrrole, aminoimidazole, aminomercaptothiazole, or the like. The monomer having an amino group and polymeric double bond may be the salts of the monomer listed above. The salts of the monomer listed above are exemplified, for example, by salts listed as the "salt of the monomer above" in "(2) Monomer Having Carboxyl Group and Polymeric Double Bond and Salt Thereof" above.

(6-2) Monomer Having Amide Group and Polymeric Double Bond

A monomer having an amide group and polymeric double bond is preferably, for example, (meth)acrylamide, N-methyl (meth)acrylamide, N-butyl (meth)acrylamide, diacetone acrylamide, N-methylol (meth)acrylamide, N,N'-methylene-bis(meth)acrylamide, cinnamic acid amide, N,N-dimethyl (meth)acrylamide, N,N-dibenzyl (meth)acrylamide, (meth)acrylformamide, N-methyl-N-vinylacetamide, or N-vinylpyrrolidone, or the like.

(6-3) Monomer Having Carbon Number from 3 to 10 and Having Nitrile Group and Polymeric Double Bond A monomer having a carbon number from 3 to 10 and having a nitrile group and polymeric double bond is preferably, for example, (meth)acrylonitrile, cyanostyrene, or cyanoacrylate, or the like.

(6-4) Monomer Having Carbon Number from 8 to 12 and Having Nitro Group and Polymeric Double Bond A monomer having a carbon number from 8 to 12 and having a nitro group and polymeric double bond is preferably, for example, nitrostyrene or the like.

(7) Monomer Having Carbon Number from 6 to 18 and Having Epoxy Group and Polymeric Double Bond A monomer having a carbon number from 6 to 18 and having an epoxy group and polymeric double bond is preferably, for example, glycidyl (meth)acrylate or the like.

(8) Monomer Having Carbon Number from 2 to 16 and Having Halogen Element and Polymeric Double Bond A monomer having a carbon number from 2 to 16 and having a halogen element and polymeric double bond is preferably, for example, vinyl chloride, vinyl bromide, vinylidene chloride, allyl chloride, chlorostyrene, bromostyrene, dichlorostyrene, chloromethylstyrene, tetrafluorostyrene, or chloroprene, or the like.

(9) Ester Having Carbon Number from 4 to 16 and Having Polymeric Double Bond

An ester having a carbon number from 4 to 16 and having polymeric double bond is preferably, for example, vinyl acetate; vinyl propionate; vinyl butyrate; diallyl phthalate; diallyl adipate; isopropenyl acetate; vinyl methacrylate; methyl-4-vinyl benzoate; cyclohexyl methacrylate; benzyl methacrylate; phenyl (meth)acrylate; vinyl methoxy acetate; vinyl benzoate; ethyl-α-ethoxy acrylate; alkyl (meth)acrylate having an alkyl group having a carbon number from 1 to 11 [such as methyl (meth)acrylate, ethyl (meth)acrylate, propyl (meth)acrylate, butyl (meth)acrylate, or 2-ethylhexyl (meth)acrylate]; dialkyl fumarate (two alkyl groups being straight-chain alkyl groups, branched alkyl groups, or alicyclic alkyl groups, having a carbon number from 2 to 8); dialkyl maleate (two alkyl groups being straight-chain alkyl groups, branched alkyl groups, or alicyclic alkyl groups, having a carbon number from 2 to 8); poly(meth)allyloxy alkanes (such as diallyloxyethane, triallyloxyethane, tetraallyloxyethane, tetraallyloxypropane, tetraallyloxybutane, or tetramethallyloxyethane); a monomer having a polyalkylene glycol chain and polymeric double bond [such as polyethylene glycol (Mn=300) mono(meth)acrylate, polypropylene glycol (Mn=500) mono(meth)acrylate, a 10-mole adduct (meth)acrylate of ethylene oxide (hereinafter "ethylene oxide" being abbreviated as "EO") to methyl alcohol, or a 30-mole adduct (meth)acrylate of EO to lauryl alcohol]; poly(meth)acrylates {such as poly(meth)acrylate of polyhydric alcohols [such as ethylene glycol di(meth)acrylate, propylene glycol di(meth)acrylate, neopentyl glycol di(meth)acrylate, trimethylol propane tri(meth)acrylate, or polyethylene glycol di(meth)acrylate]}; or the like. "(Meth) allylo" herein means allylo and/or methallylo.

A vinyl resin is preferably, for example, a styrene-(meth) acrylic acid ester copolymer, a styrene-butadiene copolymer, a (meth)acrylic acid-(meth)acrylic acid ester copolymer, a styrene-acrylonitrile copolymer, a styrene-maleic acid (maleic anhydride) copolymer, a styrene-(meth)acrylic acid copolymer, a styrene-(meth)acrylic acid-divinylbenzene copolymer, a styrene-styrene sulfonic acid-(meth)acrylic acid ester copolymer, or the like.

The vinyl resin may be a homopolymer or a copolymer of a monomer having polymeric double bond in (1) to (9)

above, or it may be a polymerized product of a monomer having polymeric double bond in (1) to (9) above and a monomer (m) having a molecular chain (k) and having polymeric double bond. The molecular chain (k) is preferably, for example, a straight-chain hydrocarbon chain having a carbon number from 12 to 27, a branched hydrocarbon chain having a carbon number from 12 to 27, a fluoro-alkyl chain having a carbon number from 4 to 20, a polydimethylsiloxane chain, or the like. A difference in SP value between the molecular chain (k) in the monomer (m) and the insulating liquid is preferably 2 or smaller. The "SP value" herein is a numeric value calculated with a Fedors' method [Polym. Eng. Sci. 14(2) 152, (1974)].

Though the monomer (m) having the molecular chain (k) and polymeric double bond is preferably, for example, monomers (m1) to (m3) below. Two or more of the monomers (m1) to (m3) may be used together as the monomer (m).

The monomer (m1) having straight-chain hydrocarbon chain having carbon number from 12 to 27 (preferably from 16 to 25) and polymeric double bond is preferably, for example, mono-straight-chain alkyl (a carbon number of alkyl being from 12 to 27) ester of unsaturated monocarboxylic acid, mono-straight-chain alkyl (a carbon number of alkyl being from 12 to 27) ester of unsaturated dicarboxylic acid, or the like. Unsaturated monocarboxylic acid and unsaturated dicarboxylic acid above are, for example, a carboxyl group containing vinyl monomer having a carbon number from 3 to 24 such as (meth)acrylic acid, maleic acid, fumaric acid, crotonic acid, itaconic acid, or citraconic acid. A specific example of the monomer (m1) is, for example, dodecyl (meth)acrylate, stearyl (meth)acrylate, behenyl (meth)acrylate, hexadecyl (meth)acrylate, heptadecyl (meth)acrylate, eicosyl (meth)acrylate, or the like.

The monomer (m2) having branched hydrocarbon chain having carbon number from 12 to 27 (preferably from 16 to 25) and polymeric double bond is preferably, for example, branched alkyl (a carbon number of alkyl being from 12 to 27) ester of unsaturated monocarboxylic acid, mono-branched alkyl (a carbon number of alkyl being from 12 to 27) ester of unsaturated dicarboxylic acid, or the like. Unsaturated monocarboxylic acid and unsaturated dicarboxylic acid are exemplified, for example, by those the same as listed as specific examples of unsaturated monocarboxylic acid and unsaturated dicarboxylic acid with regard to the monomer (m1). A specific example of the monomer (m2) is exemplified by 2-decyltetradecyl (meth)acrylate or the like.

The monomer (m3) preferably has a fluoro-alkyl chain having carbon number from 4 to 20 and polymeric double bond.

The second resin has a melting point preferably from 0 to 220° C., more preferably from 30 to 200° C., and further preferably from 40 to 80° C. From a point of view of particle size distribution and a shape of toner particles, as well as powder fluidity, heat-resistant storage stability, and resistance to stress of the liquid developer, the second resin has a melting point preferably not lower than a temperature during manufacturing of the liquid developer. If a melting point of the second resin is lower than a temperature during manufacturing of the liquid developer, it may be difficult to prevent toner particles from uniting with each other and it may be difficult to prevent the toner particles from breaking. In addition, it may be difficult to achieve a narrow width of distribution in particle size distribution of the toner particles. In other words, variation in particle size of toner particles may be great. The "melting point" can be measured with a differential scanning calorimeter (such as "DSC20" or "SSC/580" manufactured by Seiko Instruments, Inc.) in compliance with a method defined under ASTM D3418-82.

Mn of the second resin (obtained through measurement with GPC) is preferably from 100 to 5000000, more preferably from 200 to 5000000, and further preferably from 500 to 500000. The second resin has an SP value preferably from 7 to 18 $(cal/cm^3)^{1/2}$ and more preferably from 8 to 14 $(cal/cm^3)^{1/2}$.

<Coloring Agent>

A coloring agent has a particle size preferably not larger than 0.3 μm. When a coloring agent has a particle size exceeding 0.3 μm, dispersibility of the coloring agent may become poor, which may result in lowering in degree of gloss. Consequently, a desired color cannot be realized in some cases.

Though a known pigment can be employed as a coloring agent without being particularly limited, from a point of view of cost, light resistance, coloring capability, and the like, pigments below are preferably employed. In terms of color construction, these pigments are normally categorized into a black pigment, a yellow pigment, a magenta pigment, or a cyan pigment, and colors (color images) other than black are basically toned by subtractive color mixture of a yellow pigment, a magenta pigment, or a cyan pigment. A pigment shown below may be used alone, or two or more types of pigments shown below may be used together as necessary.

A pigment contained in a black coloring agent (a black pigment) may be, for example, carbon black such as furnace black, channel black, acetylene black, thermal black, or lamp black, carbon black derived from biomass, or magnetic powders of magnetite or ferrite. Nigrosine (an azine-based compound) which is a purple-black dye may be used alone or in combination. As nigrosine, C. I. Solvent Black 7 or C. I. Solvent Black 5 can be employed.

A pigment contained in a magenta coloring agent (a magenta pigment) is preferably, for example, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, or C. I. Pigment Red 222.

A pigment contained in a yellow coloring agent (a yellow pigment) is preferably, for example, C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 74, C. I. Pigment Yellow 93, C. I. Pigment Yellow 94, C. I. Pigment Yellow 138, C. I. Pigment Yellow 155, C. I. Pigment Yellow 180, or C. I. Pigment Yellow 185.

A pigment contained in a cyan coloring agent (a cyan pigment) is preferably, for example, C. I. Pigment Blue 15, C. I. Pigment Blue 15:2, C. I. Pigment Blue 15:3, C. I. Pigment Blue 15:4, C. I. Pigment Blue 16, C. I. Pigment Blue 60, C. I. Pigment Blue 62, C. I. Pigment Blue 66, or C. I. Pigment Green 7.

<Dispersant for Pigment>

A dispersant for pigment is exemplified as one example of an additive to toner particles. A dispersant for pigment has a function to uniformly disperse a coloring agent (a pigment) in toner particles and it is preferably, for example, a basic dispersant. Here, the basic dispersant refers to a dispersant defined below. Namely, 0.5 g of a dispersant for pigment and 20 ml of distilled water are introduced in a screw bottle made of glass, the screw bottle is shaken for 30 minutes with the use of a paint shaker, and the resultant product is filtered. pH of a filtrate obtained through filtration is measured with a pH meter (trade name: "D-51" manufactured by Horiba, Ltd.), and a filtrate of which pH is higher than 7 is defined as a basic dispersant. It is noted that a filtrate of which pH is lower than 7 is referred to as an acid dispersant.

A type of such a basic dispersant is not particularly limited. For example, a basic dispersant is preferably a compound (dispersant) having a functional group such as an amine group, an amino group, an amide group, a pyrrolidone group, an imine group, an imino group, a urethane group, a quaternary ammonium group, an ammonium group, a pyridino group, a pyridium group, an imidazolino group, or an imidazolium group in a molecule. It is noted that what is called a surfactant having a hydrophilic portion and a hydrophobic portion in a molecule normally falls under the dispersant, however, various compounds can be employed, so long as they have a function to disperse a coloring agent (a pigment) as described above.

A commercially available product of such a basic dispersant may be, for example, "Ajisper PB-821" (trade name), "Ajisper PB-822" (trade name), or "Ajisper PB-881" (trade name), manufactured by Ajinomoto Fine-Techno Co., Inc., or "Solsperse 28000" (trade name), "Solsperse 32000" (trade name), "Solsperse 32500" (trade name), "Solsperse 35100" (trade name), or "Solsperse 37500" (trade name), manufactured by Japan Lubrizol Limited. Since a dispersant for pigment is more preferably not dissolved in an insulating liquid, for example, "Ajisper PB-821" (trade name), "Ajisper PB-822" (trade name), or "Ajisper PB-881" (trade name), manufactured by Ajinomoto Fine-Techno Co., Inc. is more preferred. By using such a dispersant for pigment, it becomes easier to obtain toner particles having a desired shape, although a reason is not known.

Preferably 1 to 100 mass % and more preferably 1 to 40 mass % of such a dispersant for pigment is added to the coloring agent (pigment). When an amount of addition of the dispersant for pigment is lower than 1 mass %, dispersibility of the coloring agent (pigment) may be insufficient, and hence necessary ID (image density) cannot be achieved in some cases and fixation strength of toner particles may be lowered. When an amount of addition of the dispersant for pigment exceeds 100 mass %, the dispersant for pigment in an amount more than necessary for dispersing the pigment is added. Therefore, the excessive dispersant for pigment may be dissolved in the insulating liquid, which adversely affects chargeability or fixation strength of toner particles. One type alone of such a dispersant for pigment may be used or two or more types may be mixed for use.

<Shape of Toner Particles>

A median diameter D50 found through measurement of particle size distribution of toner particles based on volume (hereinafter denoted as "median diameter D50 of toner particles") is preferably not smaller than 0.5 μm and not greater than 5.0 μm. This particle size is smaller than a particle size of toner particles contained in a dry developer which has conventionally been used and represents one of the features of the present invention. If median diameter D50 of toner particles is smaller than 0.5 μm, toner particles have too small a particle size and hence mobility of toner particles in electric field may become poor, which may hence lead to lowering in development performance. If median diameter D50 of toner particles exceeds 5.0 μm, uniformity in particle size of toner particles may be lowered, which may hence lead to lowering in image quality. More preferably, toner particles have median diameter D50 not smaller than 0.5 μm and not greater than 2.0 μm.

Median diameter D50 of toner particles can be measured, for example, with a flow particle image analyzer (FPIA-3000S manufactured by Sysmex Corporation). This analyzer can use a solvent as it is as a dispersion medium. Therefore, this analyzer can measure a state of toner particles in a state closer to an actually dispersed state, as compared with a system in which measurement is conducted in a water system.

<Core/Shell Structure>

Toner particles in the present embodiment preferably have a core/shell structure. Thus, median diameter D50 of toner particles and circularity of toner particles are readily controlled. In the core/shell structure, a mass ratio between a shell resin (the second resin) and a core resin (the first resin) is preferably from 1:99 to 80:20. When a content of the second resin in the resin contained in the toner particles is lower than 1 mass %, formation of particles having the core/shell structure may become difficult. When a content of the second resin in the resin contained in the toner particles exceeds 20 mass %, fixability may lower.

In the core/shell structure, a coloring agent may be contained in the core resin or the shell resin, or in both of the core resin and the shell resin. This is also the case with an additive (for example, a dispersant for pigment) to toner particles.

<Insulating Liquid>

The insulating liquid in the present embodiment has a resistance value preferably to such an extent as not distorting an electrostatic latent image (approximately from $10^{11}$ to $10^{16}$ Ω·cm) and preferably it is a solvent having low odor and toxicity. The insulating liquid is generally exemplified by aliphatic hydrocarbon, alicyclic hydrocarbon, aromatic hydrocarbon, halogenated hydrocarbon, or polysiloxane. In particular from a point of view of low odor and toxicity as well as low cost, the insulating liquid is preferably a normal paraffin based solvent or an isoparaffin based solvent, and preferably Moresco White (trade name, manufactured by MORESCO Corporation), Isopar (trade name, manufactured by Exxon Mobil Corporation), Shellsol (trade name, manufactured by Shell Chemicals Japan Ltd.), or IP Solvent 1620, IP Solvent 2028, or IP Solvent 2835 (each of which is trade name and manufactured by Idemitsu Kosan Co., Ltd.). Two or more types of these may be used as mixed.

<Manufacturing of Liquid Developer>

The liquid developer according to the present embodiment is preferably manufactured by dispersing toner particles in an insulating liquid. Toner particles are preferably manufactured in accordance with a method shown below.

<Method of Manufacturing Toner Particles>

Toner particles are preferably manufactured based on such a known technique as a crushing method or a granulation method. In the crushing method, resin particles and a pigment are mixed and kneaded, and then the mixture is crushed. Crushing is preferably carried out in a dry state or a wet state such as in oil.

The granulation method is exemplified, for example, by a suspension polymerization method, an emulsion polymerization method, a fine particle aggregation method, a method of adding a poor solvent to a resin solution for precipitation, a spray drying method, or a method of forming a core/shell structure with two different types of resins.

In order to obtain toner particles having a small diameter and sharp particle size distribution, the granulation method rather than the crushing method is preferably employed. A resin high in meltability or a resin high in crystallinity is soft even at a room temperature and less likely to be crushed. Therefore, with the granulation method, a desired toner particle size is obtained more easily than with the crushing method. Among the granulation methods, toner particles are preferably manufactured with a method shown below. Initially, a core resin solution is obtained by dissolving a resin in a good solvent. Then, the core resin solution described above is mixed, together with an interfacial tension adjuster, in a poor solvent different in SP value from the good solvent, shear is provided, and thus a droplet is formed. Thereafter, by volatilizing the good solvent, core resin particles are obtained. With this method, controllability of a particle size or a shape of toner particles based on variation in how to provide shear, difference in interfacial tension, or an interfacial tension adjuster (a material for the shell resin) is high. Therefore, toner particles having desired particle size distribution are likely to be obtained.

<Image Formation Apparatus>

A construction of an apparatus for forming an image (image formation apparatus) which is formed by a liquid developer according to the present embodiment is not particularly limited. An image formation apparatus is preferably, for example, a monochrome image formation apparatus in which a monochrome liquid developer is primarily transferred from a photoconductor to an intermediate transfer element and thereafter secondarily transferred to a recording medium (see FIG. 3), an image formation apparatus in which a monochrome liquid developer is directly transferred from a photoconductor to a recording medium, or a multi-color image formation apparatus forming a color image by layering a plurality of types of liquid developers.

EXAMPLES

Though the present invention will be described hereinafter in further detail with reference to Examples, the present invention is not limited thereto.

Manufacturing Example 1

Manufacturing of Dispersion Liquid (W1) of Shell Particles

In a beaker made of glass, 100 parts by mass of 2-decyltetradecyl (meth)acrylate, 30 parts by mass of methacrylic acid, 70 parts by mass of an equimolar reactant with hydroxyethyl methacrylate and phenyl isocyanate, and 0.5 part by mass of azobis methoxy dimethyl valeronitrile were introduced, and stirred and mixed at 20° C. Thus, a monomer solution was obtained.

Then, a reaction vessel provided with a stirrer, a heating and cooling apparatus, a thermometer, a dropping funnel, a desolventizer, and a nitrogen introduction pipe was prepared. In that reaction vessel, 195 parts by mass of THF were introduced, and the monomer solution above was introduced in the dropping funnel provided in the reaction vessel. After a vapor phase portion of the reaction vessel was replaced with nitrogen, the monomer solution was dropped in THF in the reaction vessel for 1 hour at 70° C. in a sealed condition. Three hours after the end of dropping of the monomer solution, a mixture of 0.05 part by mass of azobis methoxy dimethyl valeronitrile and 5 parts by mass of THF was introduced in the reaction vessel and caused to react for 3 hours at 70° C. Thereafter, cooling to room temperature was carried out. Thus, a copolymer solution was obtained.

Four hundred parts by mass of the obtained copolymer solution were dropped in 600 parts by mass of IP Solvent 2028 (manufactured by Idemitsu Kosan Co., Ltd.) which was being stirred, and THF was distilled out at 40° C. at a reduced pressure of 0.039 MPa. Thus, a dispersion liquid (W1) of shell particles was obtained. A volume average particle size of the shell particles in the dispersion liquid (W1) was measured with a laser particle size distribution analyzer ("LA-920" manufactured by Horiba, Ltd.), which was 0.12 μm.

Manufacturing Example 2

Manufacturing of Solution (Y1) for Forming Core Resin

In a reaction vessel provided with a stirrer, a heating and cooling apparatus, and a thermometer, 937 parts by mass of polyester resin (Mn: 6000) obtained from sebacic acid, adipic acid, and ethylene glycol (a molar ratio of 0.8:0.2:1) and 300 parts by mass of acetone were introduced and dissolved uniformly in acetone by stirring. In the obtained solution, 63 parts by mass of IPDI were introduced and caused to react for 6 hours at 80° C. When an NCO value attained to 0, 28 parts by mass of phthalic anhydride were further added and caused to react for 1 hour at 180° C. Thus, a core resin which was a urethane-modified polyester resin was obtained. Eight hundred parts by mass of the obtained core resin and 1200 parts by mass of acetone were stirred in a beaker, to thereby uniformly dissolve the core resin in acetone. Thus, a solution (Y1) for forming a core resin was obtained.

The core resin obtained in the present Manufacturing Example had Mn of 25000, Mw of 45000, and a concentration of a urethane group of 1.44%.

Manufacturing Example 3

Manufacturing of Solution (Y2) for Forming Core Resin

A solution for forming a core resin in Manufacturing Example 3 was obtained in accordance with the method in Manufacturing Example 2 above except that a polyester resin obtained from sebacic acid, adipic acid, and ethylene glycol (a molar ratio of 0.8:0.2:1) had Mn of 5000. The core resin obtained in the present Manufacturing Example had Mn of 12000, Mw of 23000, and a concentration of a urethane group of 1.32%.

Manufacturing Example 4

Manufacturing of Solution (Y3) for Forming Core Resin

A solution for forming a core resin in Manufacturing Example 4 was obtained in accordance with the method in Manufacturing Example 2 above except that a polyester resin obtained from sebacic acid, adipic acid, and ethylene glycol (a molar ratio of 0.8:0.2:1) had Mn of 8000. The core resin obtained in the present Manufacturing Example had Mn of 40000, Mw of 72000, and a concentration of a urethane group of 1.15%.

Manufacturing Example 5

Manufacturing of Solution (Y4) for Forming Core Resin

A solution for forming a core resin in Manufacturing Example 5 was obtained in accordance with the method in Manufacturing Example 2 above except that a polyester resin obtained from sebacic acid, adipic acid, and ethylene glycol (a molar ratio of 0.8:0.2:1) had Mn of 5000. The core resin obtained in the present Manufacturing Example had Mn of 25000, Mw of 47000, and a concentration of a urethane group of 1.81%.

Manufacturing Example 6

Manufacturing of Solution (Y5) for Forming Core Resin

A solution for forming a core resin in Manufacturing Example 6 was obtained in accordance with the method in Manufacturing Example 2 above except that a polyester resin obtained from sebacic acid, adipic acid, and ethylene glycol (a molar ratio of 0.8:0.2:1) had Mn of 3000. The core resin obtained in the present Manufacturing Example had Mn of 8000, Mw of 17000, and a concentration of a urethane group of 2.29%.

Manufacturing Example 7

Manufacturing of Dispersion Liquid of Pigment

In a beaker, 20 parts by mass of acid-treated copper phthalocyanine ("FASTGEN Blue FDB-14" manufactured by DIC Corporation), 5 parts by mass of a dispersant for pigment "Ajisper PB-821" (manufactured by Ajinomoto Fine-Techno Co., Inc.), and 75 parts by mass of acetone were introduced and stirred to uniformly disperse acid-treated copper phthalocyanine. Thereafter, copper phthalocyanine was finely dispersed with the use of a bead mill. Thus, a dispersion liquid of a pigment was obtained. A volume average particle size of the pigment (copper phthalocyanine) in the dispersion liquid of the pigment was 0.2 μm.

Example 1

In a beaker, 28 parts by mass of the solution (Y1) for forming a core resin and 12 parts by mass of the solution (Y2) for forming a core resin were introduced. Thus, a solution (Y6) for forming a core resin was obtained. The urethane-modified polyester resin contained in the obtained solution (Y6) for forming a core resin had Mn of 21000, Mw of 48500, and Mw/Mn of 2.31.

Forty parts by mass of the solution (Y6) for forming the core resin and 20 parts by mass of the dispersion liquid of the pigment were introduced in a beaker and stirred at 8000 rpm with the use of TK Auto Homo Mixer [manufactured by PRIMIX Corporation] at 25° C. Thus, a resin solution (Y11) in which the pigment was uniformly dispersed was obtained.

In another beaker, 67 parts by mass of IP Solvent 2028 (manufactured by Idemitsu Kosan Co., Ltd.) and 11 parts by mass of the dispersion liquid (W1) of the shell particles were introduced to uniformly disperse the shell particles. Then, while TK Auto Homo Mixer was used at 25° C. to perform stirring at 10000 rpm, the resin solution (Y11) was introduced and stirred for 2 minutes. Then, this liquid mixture was introduced in a reaction vessel provided with a stirrer, a heating and cooling apparatus, a thermometer, and a desolventizer, and a temperature was raised to 35° C. At a reduced pressure of 0.039 MPa at that temperature, acetone was distilled out until a concentration of acetone was not higher than 0.5 mass %. Thus, a liquid developer was obtained.

Example 2

In a beaker, 28 parts by mass of the solution (Y3) for forming a core resin and 12 parts by mass of the solution (Y5) for forming a core resin were introduced. Thus, a solution (Y7) for forming a core resin was obtained. The urethane-modified polyester resin contained in the obtained solution (Y7) for forming a core resin had Mn of 30000, Mw of 84000, and Mw/Mn of 2.80.

Forty parts by mass of the solution (Y7) for forming the core resin and 20 parts by mass of the dispersion liquid of the pigment were introduced in a beaker and stirred at 8000 rpm with the use of TK Auto Homo Mixer [manufactured by PRIMIX Corporation] at 25° C. Thus, a resin solution (Y12) in which the pigment was uniformly dispersed was obtained.

In another beaker, 67 parts by mass of IP Solvent 2028 (manufactured by Idemitsu Kosan Co., Ltd.) and 11 parts by mass of the dispersion liquid (W1) of the shell particles were introduced to uniformly disperse the shell particles. Then, while TK Auto Homo Mixer was used at 25° C. to perform stirring at 10000 rpm, the resin solution (Y12) was introduced and stirred for 2 minutes. Then, this liquid mixture was introduced in a reaction vessel provided with a stirrer, a heating and cooling apparatus, a thermometer, and a desolventizer, and a temperature was raised to 35° C. At a reduced pressure of 0.039 MPa at that temperature, acetone was distilled out until a concentration of acetone was not higher than 0.5 mass %. Thus, a liquid developer was obtained.

Examples 3 to 4, Comparative Examples 1 to 3

Liquid developers in Examples 3 to 4 were obtained in accordance with the method described in Example 1 above except that the solutions (Y1) to (Y5) for forming a core resin were mixed in accordance with the ratios shown in Table 2. Liquid developers in Comparative Examples 1 to 3 were obtained in accordance with the method described in Example 1 above except that the solutions for forming a core resin shown in Table 2 were employed.

<Fixation Process>

Figure 3:
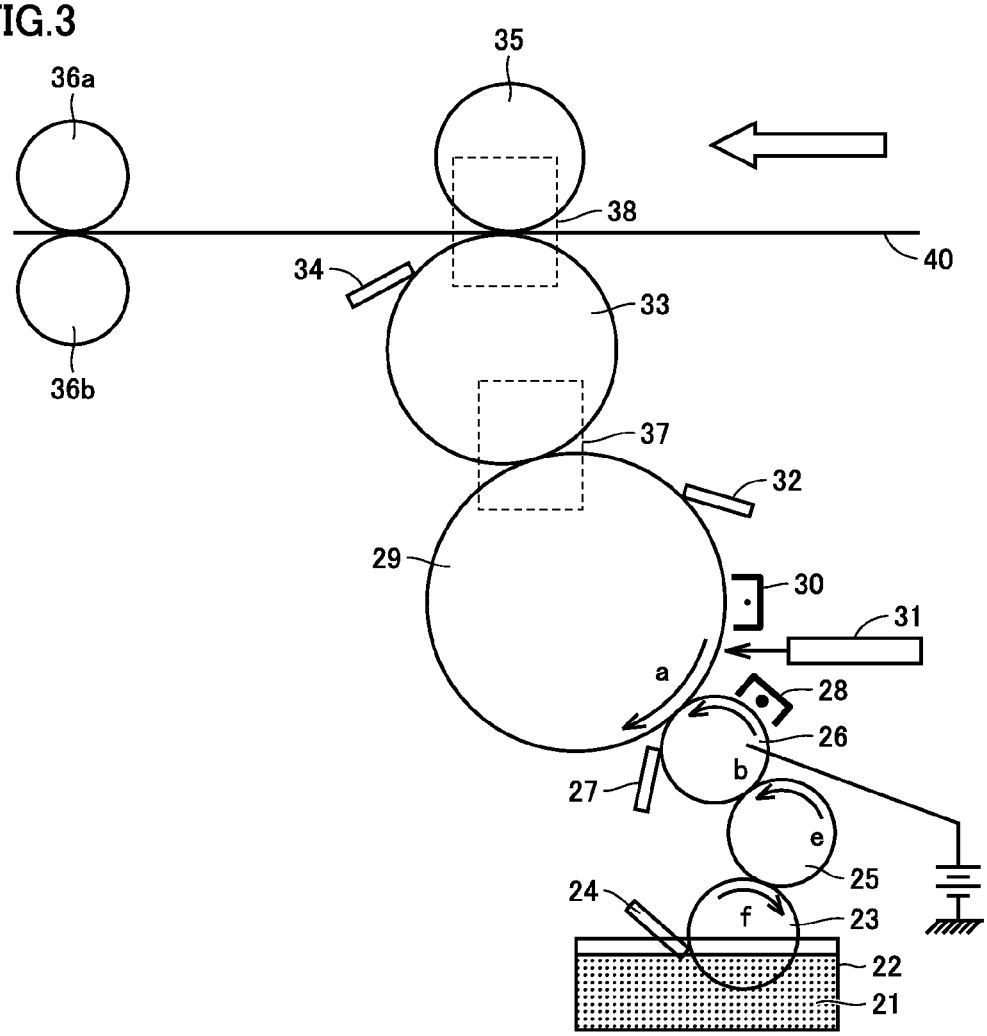
FIG. 3 is a schematic conceptual diagram of an image formation apparatus of an electrophotography type.

An image was formed by using an image formation apparatus shown in FIG. 3. A construction of the image formation apparatus shown in FIG. 3 is shown below. A liquid developer 21 is brought up from a development tank 22 by an anilox roller 23. Excessive liquid developer 21 on anilox roller 23 is scraped off by an anilox restriction blade 24, and remaining liquid developer 21 is sent to a leveling roller 25. Liquid developer 21 is adjusted to be uniform and small in thickness, on leveling roller 25.

Liquid developer 21 on leveling roller 25 is sent to a development roller 26. The excessive liquid developer on development roller 26 is scraped off by a development cleaning blade 27, and remaining liquid developer 21 is charged by a development charger 28 and developed on a photoconductor 29. Specifically, a surface of photoconductor 29 is evenly charged by a charging portion 30, and an exposure portion 31 arranged around photoconductor 29 emits light based on prescribed image information to the surface of photoconductor 29. Thus, an electrostatic latent image based on the prescribed image information is formed on the surface of photoconductor 29. As the formed electrostatic latent image is developed, a toner image is formed on photoconductor 29. The excessive liquid developer on photoconductor 29 is scraped off by a cleaning blade 32.

The toner image formed on photoconductor 29 is primarily transferred to an intermediate transfer element 33 at a primary transfer portion 37, and the liquid developer transferred to intermediate transfer element 33 is secondarily transferred to a recording medium 40 at a secondary transfer portion 38. The liquid developer transferred to recording medium 40 is fixed by fixation rollers 36*a* and 36*b*. The liquid developer which remained on intermediate transfer element 33 without being secondarily transferred is scraped off by an intermediate transfer element cleaning portion 34.

In the present Example, the surface of photoconductor 29 was positively charged by charging portion 30, a potential of intermediate transfer element 33 was set to −400 V, a potential of a secondary transfer roller 35 was set to −1200 V, a fixation NIP time was set to 40 milliseconds, and a temperature of fixation rollers 36*a* and 36*b* was set to 120° C. OK top coat (manufactured by Oji Paper Co., Ltd., 128 g/m$^2$) was employed as recording medium 40 and a velocity of transportation of recording medium 40 was set to 400 mm/s.

<Median Diameter D50>

A flow particle image analyzer (FPIA-3000S manufactured by Sysmex Corporation) was used to measure an average particle size of the liquid developers in Examples 1 to 4 and Comparative Examples 1 to 3. IP Solvent 2028 which was the same solvent as that for the insulating liquid was employed as a flow solvent. Initially, a suspension was obtained by introducing 50 mg of the liquid developer (a liquid developer in each of Examples 1 to 4 and Comparative Examples 1 to 3) into Isopar L (20 g) containing 30 mg of 513940 (manufactured by Japan Lubrizol Limited) as a dispersant. Then, an ultrasound disperser (manufactured by Velvo-Clear, ultrasonic cleaner model VS-150) was used to subject the resultant suspension to dispersion treatment for approximately 5 minutes. The flow particle image analyzer was used to measure median diameter D50 at the time when particle size distribution of the resultant sample was measured based on volume. Results are shown in D50 in Table 2.

<Document Offset>

While fixed images were layered on each other, load of 80 g/m$^2$ was applied thereto and stored for 1 week at 55° C. Thereafter, after the temperature was lowered to room temperature and the load was removed, two sheets were separated from each other and whether or not the images were damaged at the time of separation was checked. Results are shown in document offset in Table 2. In Table 2, a case that the images were not separated at the time of separation is denoted as A1 and a case that the images were separated at the time of separation is denoted as B1. It can be concluded that no document offset took place if the images were not separated at the time of separation.

<Damage Resistance>

A pencil hardness test was conducted. Under JIS K5400, a pencil of HB was pressed against an image surface at an angle of 45 degrees under a load of 1 kg. Results are shown in damage resistance in Table 2. In Table 2, a case that the image surface was not damaged is denoted as A2 and a case that the image surface was damaged is denoted as B2. It can be concluded that damage resistance of a document is excellent if the image surface is not damaged.

TABLE 1

| Solution for Forming Core Resin | Urethane-Modified Polyester Resin | | | |
|---|---|---|---|---|
| | Mn | Mw | Mw/Mn | Concentration of Urethane Group (%) |
| Y1 | 25000 | 45000 | 1.8 | 1.44 |
| Y2 | 12000 | 23000 | 1.9 | 1.32 |
| Y3 | 40000 | 72000 | 1.8 | 1.15 |
| Y4 | 25000 | 47000 | 1.9 | 1.81 |
| Y5 | 8000 | 17000 | 2.1 | 2.29 |

TABLE 2

| | Solution for Forming Core Resin | | Urethane-Modified Polyester Resin | | | | | | |
|---|---|---|---|---|---|---|---|---|---|
| | Material | Ratio of Content (Mass %) | Mn | Mw | Mw/Mn | Concentration of Urethane Group (%) | D50 (μm) | Document Offset | Damage Resistance |
| Example 1 | Y1 and Y2 | Y1/Y2 = 70/30 | 21000 | 48500 | 2.31 | 1.40 | 1.22 | A1 | A2 |
| Example 2 | Y3 and Y5 | Y3/Y5 = 70/30 | 30000 | 84000 | 2.80 | 1.34 | 1.41 | A1 | A2 |
| Example 3 | Y2 and Y4 | Y4/Y2 = 75/25 | 21000 | 50000 | 2.38 | 2.09 | 1.18 | A1 | A2 |
| Example 4 | Y1 and Y5 | Y1/Y5 = 50/50 | 17000 | 47000 | 2.76 | 1.61 | 1.35 | A1 | A2 |
| Comparative Example 1 | Y1 | 100 | 25000 | 45000 | 1.80 | 1.44 | 1.24 | B1 | A2 |
| Comparative Example 2 | Y3 | 100 | 40000 | 72000 | 1.80 | 1.15 | 1.44 | B1 | A2 |
| Comparative Example 3 | Y5 | 100 | 8000 | 17000 | 2.13 | 1.78 | 1.03 | A1 | B2 |

As shown in Table 2, in Examples 1 to 4, no document offset occurred and damage resistance of a document was excellent. On the other hand, in Comparative Examples 1 and 2, document offset occurred. The reason may be because Mw/Mn was smaller than 2.3 (2.3>Mw/Mn) and Mn was great in Comparative Examples 1 and 2. In Comparative Example 3, damage resistance of a document was poor. The reason may be because Mw/Mn was smaller than 2.3 (2.3>Mw/Mn) and Mn was small in Comparative Example 3. The present inventors could not manufacture a urethane-modified polyester resin satisfying relation of Mw/Mn>4.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A liquid developer, comprising:

an insulating liquid; and toner particles which are dispersed in said insulating liquid and contain a resin and a coloring agent, said resin containing a first resin which is a urethane-modified polyester resin resulting from increase in chain length of a component derived from a polyester resin by a compound containing an isocyanate group and a second resin different from said first resin, said first resin being contained by not lower than 70 mass % with respect to a total of said first resin and said second resin, said component derived from the polyester resin containing a constitutional unit derived from an acid component and a constitutional unit derived from an alcohol component, a ratio of a constitutional unit derived from an aliphatic monomer occupied in said constitutional unit derived from the acid component and said constitutional unit derived from the alcohol component being not lower than 80 mass %, relation of $2.3 \leq Mw/Mn \leq 4$ ($10000 \leq Mn \leq 50000$) being satisfied, where Mn represents a number average molecular weight of said first resin and Mw represents a weight average molecular weight of said first resin, and wherein said second resin includes at least one resin selected from the group consisting of a vinyl resin, a polyester resin, a polyurethane resin, an epoxy resin, a polyamide resin, a polyimide resin, a silicon resin, a phenol resin, a melamine resin, a urea resin, an aniline resin, an ionomer resin, and a polycarbonate resin.

2. The liquid developer according to claim 1, wherein said first resin has a concentration of a urethane group not lower than 0.5% and not higher than 5%.

3. The liquid developer according to claim 2, wherein said first resin has a concentration of a urethane group not lower than 1% and not higher than 3%.

4. The liquid developer according to claim 1, wherein said second resin is a vinyl resin.

5. The liquid developer according to claim 4, wherein said toner particles have a core/shell structure.

6. The liquid developer according to claim 1, wherein said toner particles have a core/shell structure, wherein the core/shell structure comprises said first resin as a core and said second resin as a shell, and wherein said second resin adheres to at least a part of surfaces of a first plurality of particles comprising said first resin.

7. The liquid developer according to claim 1, wherein the liquid developer comprises from 10 to 50 mass % of said toner particles and from 50 to 90 mass % of said insulating liquid.

8. The liquid developer according to claim 1, wherein said resin comprises at least 70 mass % of said first resin.

9. The liquid developer according to claim 1, wherein said ratio of said constitutional unit derived from an aliphatic monomer occupied in said constitutional unit derived from the acid component and said constitutional unit derived from the alcohol component being not lower than 90 mass %.

10. The liquid developer according to claim 9, wherein said ratio of said constitutional unit derived from an aliphatic monomer occupied in said constitutional unit derived from the acid component and said constitutional unit derived from the alcohol component is 100 mass %.

11. The liquid developer according to claim 1, wherein relation of $2.5 \leq Mw/Mn \leq 3.5$ is satisfied.

12. The liquid developer according to claim 11, wherein relation of ($10000 \leq Mn \leq 30000$) is satisfied.

13. The liquid developer according to claim 1, wherein relation of ($10000 \leq Mn \leq 30000$) is satisfied.

14. The liquid developer according to claim 1, wherein said second resin includes at least one resin selected from the group consisting of a vinyl resin, a polyester resin, a polyurethane resin, and an epoxy resin.

15. The liquid developer according to claim 1, wherein relation of ($100 \leq Mn2 \leq 5000000$) is satisfied where Mn2 represents a number average molecular weight of said second resin.

16. The liquid developer according to claim 15, wherein relation of ($200 \leq Mn2 \leq 5000000$) is satisfied.

17. The liquid developer according to claim 16, wherein relation of ($500 \leq Mn2 \leq 500000$) is satisfied.

* * * * *